United States Patent [19]

Kessel

[11] 4,074,686

[45] Feb. 21, 1978

[54] MANUALLY CLOSABLE ANTI-BACKUP TRAP

[76] Inventor: Bernhard Kessel, Ingolstadter Str. 20, 8073 Kosching, Germany

[21] Appl. No.: 688,282

[22] Filed: May 20, 1976

[30] Foreign Application Priority Data

May 21, 1975 Germany ..... 2522426
May 21, 1975 Germany ..... 2522427

[51] Int. Cl.[2] ..... E03C 1/286; E03C 1/288

[52] U.S. Cl. ..... 137/247.19; 137/247.27; 137/614.16; 137/614.2

[58] Field of Search ..... 4/287; 137/247.13, 247.23, 137/247.27, 614.16, 614.2

[56] References Cited

U.S. PATENT DOCUMENTS

| | | | |
|---|---|---|---|
| 873,518 | 12/1907 | Donat | 137/247.13 |
| 3,491,796 | 1/1970 | Scaramucci | 137/614.2 |

FOREIGN PATENT DOCUMENTS

| | | | |
|---|---|---|---|
| 64,265 | 1/1946 | Denmark | 137/247.19 |
| 376,077 | 5/1964 | Switzerland | 137/614.16 |

*Primary Examiner*—Robert G. Nilson
*Attorney, Agent, or Firm*—Karl F. Ross

[57] ABSTRACT

A trap for a drain has a housing with a lateral exit port for water flowing in through an apertured lid and/or through a lateral entrance port. A tubular insert fitted to the sidewall with the exit port has a bottom inlet beneath the level of that port and a side outlet provided with a check valve in the form of a hinged flap swinging outwardly into the exit port. In one embodiment, the flap comes to rest on the broad end of a frustoconical shutter rotatably seated in the upper end of the insert which is separated by a correspondingly curved partition from the lower end; the shutter and the partition have apertures which normally register with each other but can be disaligned by a rotation of the shutter about a horizontal axis with the aid of a handle secured to it inside the housing and accessible upon removal of the lid. In another embodiment, a similarly accessible handwheel atop the insert has a tubular shaft threadedly engaging a vertical leadscrew rising from a shutter disk which lies between the bottom opening and a horizontal partition having an aperture that is closable by the disk from below.

6 Claims, 4 Drawing Figures

MANUALLY CLOSABLE ANTI-BACKUP TRAP

CROSS-REFERENCE TO RELATED APPLICATIONS

This application is related to my copending applications Ser. Nos. 688,283 and 688,309 both filed on 20 May, 1976.

FIELD OF THE INVENTION

My present invention relates to a trap for a drain, designed to conduct waste water from a sump, gully or the like to a sewer.

BACKGROUND OF THE INVENTION

In such a trap, especially one installed in a basement or some other part of a dwelling, it is desirable to provide means for not only blocking the escape of sewer gases but also preventing a backup of water from the sewer to the trap. Under severe overflow conditions, as where a sewer is flooded in a downpour, it is desirable to rely for this purpose on a shutter more effective than a simple check valve to stop the flow. A trap with a dual seal, i.e. a check valve in the form of a ball float and a shutter closable by a handwheel, is known for example from German utility model No. 1,917,289. Such a construction, however, is relatively cumbersome and requires an enlargement of the drain in comparison with more usual traps. Even so, the assembly of shutter and float valve is not easily installed and is difficult to extract.

OBJECT OF THE INVENTION

The object of my present invention, therefore, is to provide an improved anti-backup trap including a manually closable valve which is of compact construction and can be fitted to a normal drain without major alterations.

SUMMARY OF THE INVENTION

I realize this object, in accordance with my present invention, by providing a tubular insert adjacent a sidewall of an upwardly open housing, this insert having a lateral outlet registering with an exit port in that sidewall and further having a bottom inlet beneath the level of that port. A flap hinged to the insert for outward swinging forms a check valve which facilitates the outflow of water from the housing but prevents any return flow from the exit port. The insert also contains a manually operable shutter mechanism interposed between its inlet and its outlet, the shutter mechanism being accessible through the top of the housing upon the removal of a lid normally overlying that top.

The shutter mechanism of my improved anti-backup trap includes an apertured partition within the insert and a coacting valve member located either below or above that partition. In one embodiment, the partition is curved about a substantially horizontal axis at the center of the outlet, the valve member having a tubular body with a peripheral wall which conforms to the curvature of the partition and rotatably rests thereon whereby a peripheral opening in that body can be aligned with the partition aperture in an unblocking position and can be disaligned therefrom in a blocking position. In another embodiment the valve body is a horizontal disk which is vertically displaceable between a blocking and an unblocking position with the aid of a handwheel through the intermediary of a leadscrew coupling.

BRIEF DESCRIPTION OF THE DRAWING

The above and other features of may invention will now be described in detail with reference to the accompanying drawing in which.

SPECIFIC DESCRIPTION

Figure 1:
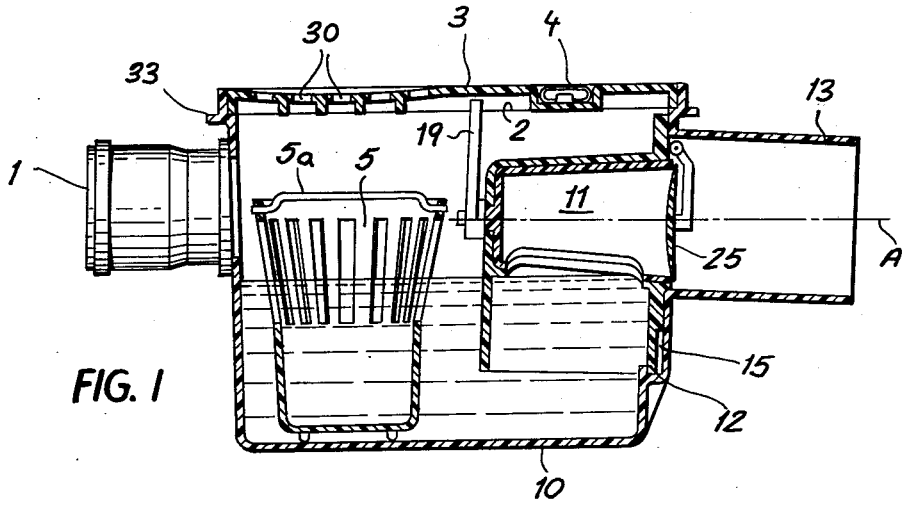
FIG. 1 is a longitudinal sectional view of an anti-backup trap embodying my invention.
Figure 4:
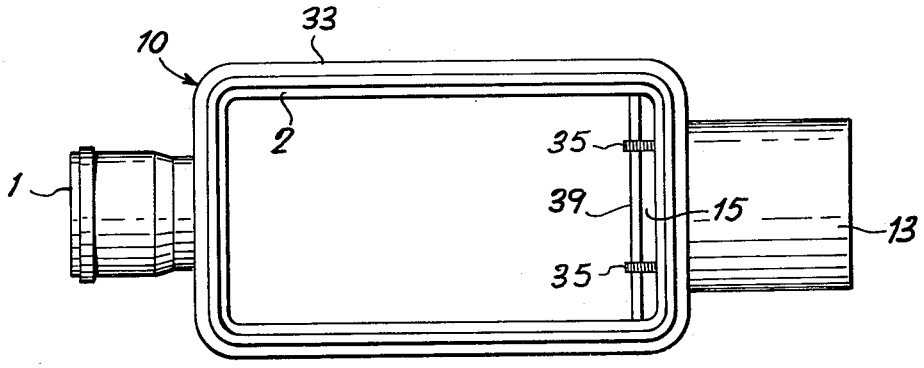
FIG. 4 is a top view of the housing of the trap shown in FIG. 1.

As illustrated in FIGS. 1 and 4, a trap according to my invention comprises a housing 10 of rectangular outline whose open top forms a peripheral rabbet 2 for the seating of a removable lid 3. The left-hand half of the lid is provided with a multiplicity of perforations 30 through which rainwater or other liquid wastes may enter the housing 10. The right-hand half of the lid 3 has a countersunk grip 4 to facilitate its removal from the housing. Also illustrated in FIG. 1 is a lateral entrance port 1 through which waste water collected elsewhere, e.g. in a kitchen sink, can pass into the trap housing. A nipple 13 on the opposite sidewall of the housing, forming an exit port, is tilted slightly downwardly for connection to a nonillustrated sewer pipe. It will be noted that both ports 1 and 13 lie in the upper half of housing 10.

Figure 2:
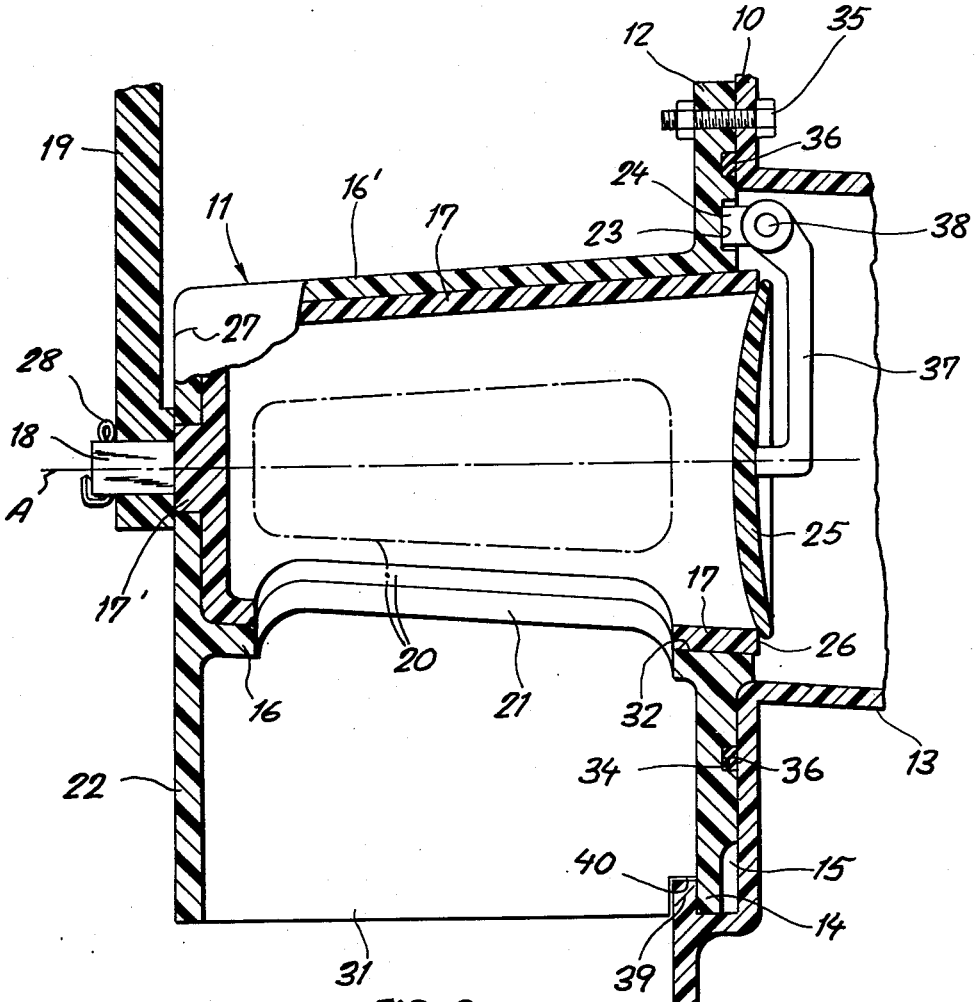
FIG. 2 is a similar view, drawn to a larger scale, of an insert forming part of the trap of FIG. 1.

A tubular insert 11 is molded or deep-drawn from a tough and corrosion-resistant plastic material, such as polyester, from which the housing 10 and its lid 3 may also be formed in like manner. Insert 11 is removably seated in the housing 10 adjacent its right-hand sidewall provided with the exit port 13. This insert, more fully illustrated in FIG. 2, comprises essentially a downwardly open conduit 22 forming a depending skirt around a bottom inlet 31; an outlet 32 on the side of the conduit registers with exit port 13 and is centered on a horizontal axis A. An upwardly concave partition 16 integral with conduit 22, centered on axis A, has an elongate aperture 21 extending over the greater part of its axial length. Partition 16 forms with the complementarily curved top 16' of conduit 22 a frustoconical shell tightly embracing a hollow frustoconical valve body 17 coaxial therewith. Valve body 17, made of the same resinous material as conduit 22, has an opening 20 which is similar to aperture 21 and registers therewith in a normal unblocking position as illustrated in solid lines in FIG. 2. In an alternate blocking position, illustrated in dot-dash lines, aperture 21 is closed.

Conduit 22 forms an integral flange 12 around the outlet 32 which is defined by the broader end of the stationary frustoconical shell 16, 16'. A circular groove 34 in this flange accommodates a packing ring 36 to form a fluidtight seal with the confronting sidewall of housing 10. The broad end of valve body 17, open toward exit port 13, projects slightly beyond flange 12 and forms an annular seat 26 for a circular flap 25 acting as a check valve. Flap 25 has an arm 37 which is hinged at 38 to a lug 24 firmly held in a recess 23 of flange 12. Hinge 38 lies directly above the seat 26 so that the flap 25, in the absence of countervailing fluid pressure, returns under its own weight to its illustrated closure position in which a convex face thereof comes to rest against that seat. As the entering water rises within tube 22 above partition 16, the flap 25 is thrust aside and swings outwardly into the exit port 13 to let the water escape into the adjoining drain pipe.

The smaller, closed end of valve body 17 has a boss 17′ journaled in the opposite wall of conduit 22, this boss terminating in a square head 18 to which a handle 19 is removably fastened with the aid of a cotter pin 28. Handle 19, as shown in FIG. 1, can be easily reached upon the removal of lid 3 and can be swung through about 90° to establish either the unblocking or the blocking position of valve body 17. In either position the handle will include an angle of about 45° with the vertical; markings 27 (only one shown in FIG. 2) may be provided on the outside of insert 11 to indicate the open or the closed state of the valve.

The right-hand sidewall of housing 10 is formed with an upwardly open pocket 15 bounded by a lip 39 which enters a pair of corresponding notches 40 (only one shown) in the bottom edge of conduit 22 to insure a proper seating of insert 11 in the housing; a flat foot 14, separated by the notches 40 from a cylindrical part of the skirt surrounding its inlet opening 31, fits from above into pocket 15. The mounting of the insert 11 is completed with the aid of bolts 35 projecting inwardly from the right-hand housing wall on opposite sides of recess 23 (see also FIG. 4) and passing through nonillustrated lateral holes of flange 12. Reference is made in this connection to my copending applications identified above.

As further shown in FIG. 1, and as also disclosed in these copending applications, the left-hand half of housing 10 underneath the perforated section of lid 3 may hold a removable filter screen, in the form of a basket 5 with handle 5*a*, designed to catch solid objects such as pebbles dropping through the lid into the housing.

The water level inside the housing is normally defined by the lower edge of outlet 32, except upon closure of shut-off valve 16, 17 in which case that level may go higher.

Figure 3:
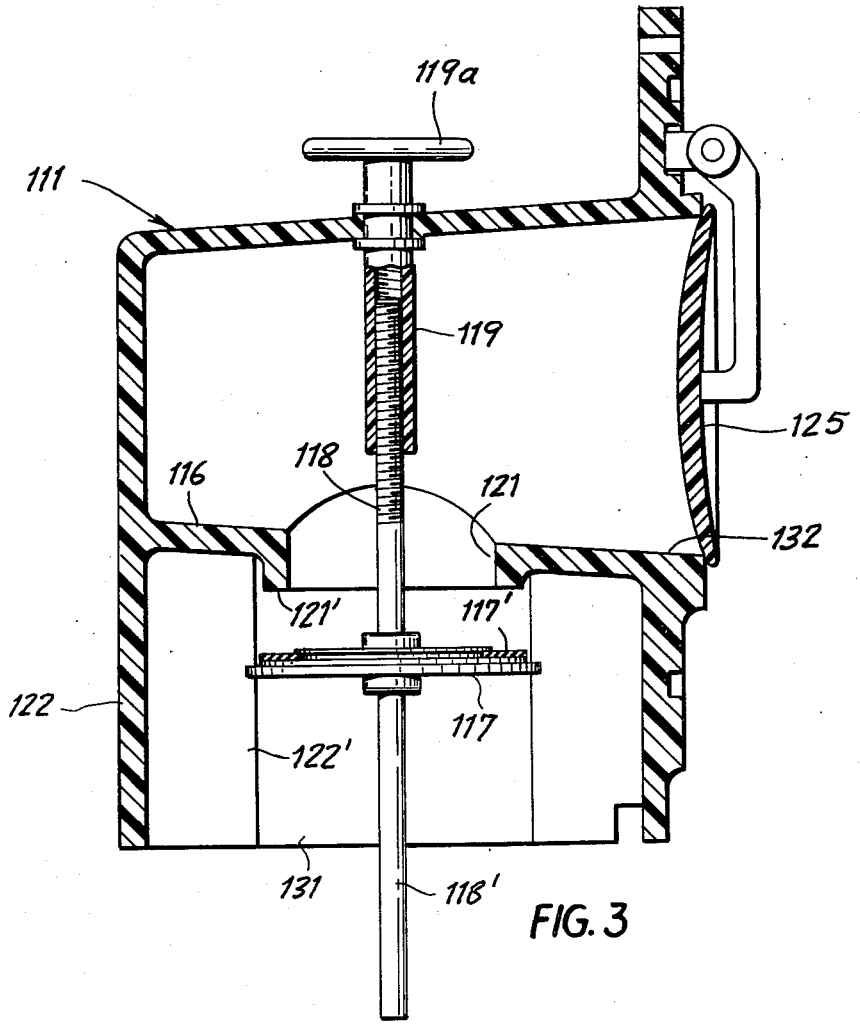
FIG. 3 is a view similar to FIG. 2, showing another embodiment.

In FIG. 3 I have shown an alternate insert 111, comprising a conduit 122 of a shape generally similar to that of conduit 22, forming again a bottom inlet 131 and a lateral outlet 132 closable by a flap 125. A partition 116, disposed horizontally between the inlet and the outlet, has a circular aperture 121 bounded by a depending rim 121′ which constitutes a seat for a valve body 117 in the shape of a horizontal disk. Partition 116, integral with the tubular housing wall 122, lies just below the level of outlet 132. Underneath that partition, conduit 122 has a set of vertical ribs 122′ which enter into peripheral notches of disk 117 and hold it against rotation. The disk, whose diameter is substantially less than the width of conduit 122, is rigid with a vertical leadscrew 118 which is threadedly engaged by a nut 119 rotatably journaled in the top wall of the conduit. Nut 119 terminates in a handwheel 119*a*, accessible upon removal of lid 3 (FIG. 1), whose rotation raises the disk 117 from its illustrated unblocking position into a blocking position on seat 121′. A depending stem 118′, forming a downward extension of leadscrew 118, limits the downward stroke of the disk by coming to rest on the bottom of housing 10. A sealing ring is shown at 117′.

In both inserts 11 and 111 the water entering from the bottom can normally reach the outlet via a flow path whose cross-section is at least equal to that of the outlet. The skirt formed by the conduit 22 or 122 below the normal water level should be high enough to prevent the escape of sewer gases into the housing, that height being preferably not less than the diameter of outlet 32 or 132.

As illustrated in FIGS. 1 and 4, the rim of the housing surrounding its inner rabbet 2 is provided with an outer peripheral flange 33 facilitating the clamping of that housing to an upward extension as described in my concurrently filed application Ser. No. 688,283.

The easy detachability of handle 19 simplifies the cleaning of insert 11, upon its removal from housing 10, since it is merely necessary for that purpose to extract the valve body 17 by its broader end from the shell 16, 16′. Even without such removal, the relative rotation of these two valve members with the aid of handle 19 has a cleansing effect and impedes the accumulation of grit between their coacting surfaces.

I claim:

1. An anti-backup trap for a drain, comprising:

an upwardly open housing having a sidewall provided with an exit port for entering waste water;

a tubular insert in said housing adjacent said sidewall, said insert having a bottom inlet beneath the level of said exit port and a side outlet registering with said exit port;

a flap hinged to said insert for outward swinging to facilitate the outflow of water, said flap forming a check valve to prevent the return of water from said exit port to said housing; and manually operable shutter means in said insert interposed between said inlet and said outlet, said shutter means being accessible through the top of said housing;

said insert being provided with an apertured partition curved about a substantially horizontal axis, said outlet being substantially centered on said axis, said shutter means comprising a tubular valve body with a peripheral wall conforming to the curvature of said partition, said body resting on said partition for rotation about said axis and having a peripheral opening alignable with an aperture of said partition in an unblocking position.

2. A trap as defined in claim 1 wherein said body is frustoconical with its broader end adjacent said outlet, said partition forming with the top of said insert a complementary frustoconical seat for said body.

3. A trap as defined in claim 2 wherein said broader end projects from said insert toward said exit port, said flap being hinged to said insert above said broader end for coming to rest thereagainst under its own weight.

4. A trap as defined in claim 1 wherein said body has a stub shaft projecting outwardly from said insert at a location opposite said outlet, further comprising a handle on said stub shaft manipulable to rotate said body through about 90° between said unblocking position and a blocking position in which said opening is disaligned from said aperture.

5. A trap as defined in claim 4 wherein said insert is provided with a marking for indicating at least one of said positions.

6. A trap as defined in claim 1 wherein said opening and said aperture are substantially coextensive cutouts extending over the major part of the axial length of said body.

* * * * *